US011014093B1

(12) United States Patent
Drexler et al.

(10) Patent No.: US 11,014,093 B1
(45) Date of Patent: May 25, 2021

(54) SECURE DESTRUCTION MACHINE

(71) Applicant: Amazon Technologies, Inc., Seattle, WA (US)

(72) Inventors: Shane Drexler, Seattle, WA (US); Avirbhav Kalva, Seattle, WA (US); Eric Jason Brandwine, Haymarket, VA (US); Thomas Joseph Lauducci, Worthington, OH (US); David Francis Carter, Bothell, WA (US); Ruicong Yuan, Seattle, WA (US)

(73) Assignee: Amazon Technologies, Inc., Seattle, WA (US)

( * ) Notice: Subject to any disclaimer, the term of this patent is extended or adjusted under 35 U.S.C. 154(b) by 493 days.

(21) Appl. No.: 15/821,560

(22) Filed: Nov. 22, 2017

(51) Int. Cl.

| | |
|---|---|
| ***B02C 25/00*** | (2006.01) |
| ***B02C 18/00*** | (2006.01) |
| ***B02C 18/22*** | (2006.01) |
| ***B02C 21/02*** | (2006.01) |

(52) U.S. Cl.
CPC ..... *B02C 25/00* (2013.01); *B02C 18/0084* (2013.01); *B02C 18/2241* (2013.01); *B02C 21/02* (2013.01); *B02C 2018/0015* (2013.01)

(58) Field of Classification Search
CPC ..... B02C 18/2241; B02C 2018/0015; B02C 25/00; B02C 18/0084; B02C 21/02
USPC ..... 241/14, 33, 223, 236
See application file for complete search history.

(56) References Cited

U.S. PATENT DOCUMENTS 5,039,020 A * 8/1991 Leuthold ..... B02C 18/0007 241/30
5,659,396 A * 8/1997 Mondie ..... B65H 7/125 250/223 R
9,250,597 B2 * 2/2016 Tsuchihashi ..... B02C 18/0007
(Continued)

FOREIGN PATENT DOCUMENTS

WO WO-2019075530 A1 * 4/2019 ..... B02C 18/00

OTHER PUBLICATIONS

Garner Products, Inc., 'PD-8700 Hard Drive Degausser & Destroyer', 2009, p. 1, https://www.virtualvision.nl/download/brochure_degausser_pd-8700.pdf (Year: 2009).*
(Continued)

*Primary Examiner* — Teresa M Ekiert
*Assistant Examiner* — Jared O Brown
(74) *Attorney, Agent, or Firm* — Kilpatrick Townsend & Stockton LLP

(57) ABSTRACT

A system includes an enclosure about a path toward a physical damaging system configured for rendering media storage devices inoperable. A scanning system obtains identifying information of a media storage device in the path. A barrier is selectively movable between an accessible state in which media storage device introduction into the enclosure is permitted and a blocking state in which such introduction into the enclosure is prevented. A locking mechanism locks the barrier in the blocking state in response to the barrier being moved to the blocking state. The locking mechanism unlocks the barrier and permits a shift to the accessible state subsequent to the scanning system obtaining the identifying information and subsequent to an action triggered based on the identifying information obtained from the scanning system.

14 Claims, 2 Drawing Sheets

(56) References Cited

U.S. PATENT DOCUMENTS

| | | | | |
|---|---|---|---|---|
| 2005/0049745 | A1* | 3/2005 | LeVasseur | B65G 43/10 700/230 |
| 2006/0196926 | A1* | 9/2006 | Benson | G07F 17/12 235/375 |
| 2007/0147776 | A1* | 6/2007 | Ito | G11B 23/505 386/254 |
| 2019/0017863 | A1* | 1/2019 | Saltzman | G07F 7/06 |

OTHER PUBLICATIONS

Shredfast, Inc., 'Shredding Tecnology: Part 1-Hammermill', Jan. 6, 2014, p. 1, https://shredfast.com/technology/shredding-technology-part-1-hammermill/ (Year: 2014).*

U.S. Appl. No. 14/736,609, U.S. Patent Application, filed Jun. 11, 2015, Titled: Hardware Sanitization and Destruction Machine.

* cited by examiner

SECURE DESTRUCTION MACHINE

BACKGROUND

In an era of ever-increasing reliance on data retention within cloud computing infrastructure, physical security of computer processing assets is an important consideration. Especially for large-scale cloud computing service providers, as computer processing assets are cycled out of useful life (e.g., due to routine upkeep or other reasons for replacement), appropriate disposal can become a non-trivial matter.

BRIEF DESCRIPTION OF THE DRAWINGS

Various embodiments in accordance with the present disclosure will be described with reference to the drawings, in which.

DETAILED DESCRIPTION

Figure 1:
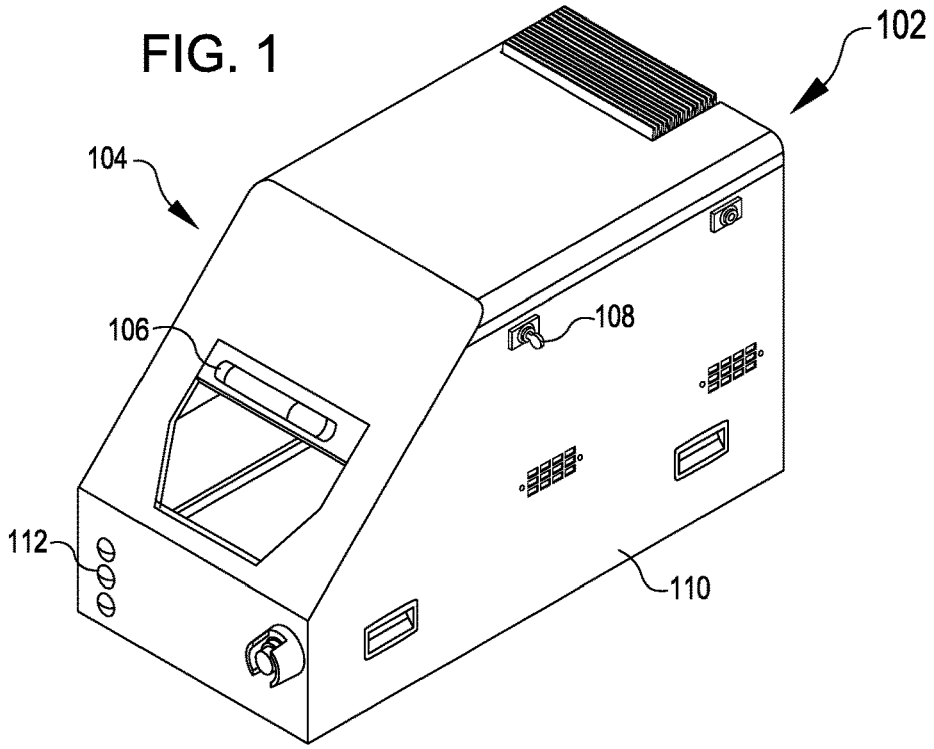
FIG. 1 illustrates a module that may be utilized for regulating input of drives for processing and/or disposal according to various embodiments.

In the following description, various embodiments will be described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

Embodiments herein relate to techniques and components associated with shredders or other forms of devices that physically damage hard disk drives, solid state drives, or other media storage devices for secure disposal in a manner that prevents subsequent access to customer data or other forms of sensitive data that may have been electronically stored on the media storage devices. Access to the shredder can be directed through or along a path that includes several components. The path may be surrounded by an enclosure such that once introduced into the path, a media storage device will be effectively irretrievable by the individual that introduced it. In this way, the media destruction machine may be conceived as a "closed loop," a "closed track," or a "one-way street" toward the shredder.

In one example, a machine features a door at a beginning of an enclosed path toward a shredder. In operation, a user may open the door, insert a drive (e.g., a media storage device), and close the door to cause the inserted drive to be processed through the machine. The door may remain locked until the drive has been completely processed by the machine, thus preventing the user from retrieving the drive after introduction into the path. The drive is passed through the machine in this example via conveyor belts that are controlled by a control system of the machine, e.g., in response to closing and/or locking of the door and/or in response to other inputs from components within the machine.

On the path toward the shredder in this example, the drive passes a degausser, which "sanitizes" the drive by magnetically erasing data from the drive. The drive in this example also passes a scanner that obtains an optical reading of both the top and bottom of the drive, for example, by taking respective images of both sides of the drive. From the optical reading, a barcode or other identifying indicia is extracted, permitting identification of the drive by the control system of the machine. The identity of the drive is compared to a database to confirm that the drive is designated for destruction. The identity of the drive is also stored to confirm that the specific drive identified has moved within the enclosure to the shredder for destruction. The drive is processed by the shredder, becoming mangled or otherwise physically deformed, crushed, damaged, torn, etc. and resulting in the drive becoming one or more pieces that are rendered inoperable for data previously stored on the drive. Overall, as a result of passage through such a machine, a drive designated for destruction may be scanned to confirm passage of the drive to the shredder within an enclosed environment; this may prevent or reduce a risk of the drive being scanned by an individual to indicate that the drive has been destroyed and then misplaced or redirected without reaching the shredder.

In some embodiments, other features may be included to facilitate confirmation that a drive has been destroyed and has not somehow circumvented a part of the process of destruction and/or the accompanying process of registering the drive as destroyed. For example, the machine may include a scale or other weight detector near an input of a machine and another weight detector at a later part of the machine (such as a collection bin for receiving debris from the shredder). The machine may utilize information from the scales to compare and confirm that input weights and output weights are the same or suitably matched to confirm that a given drive was processed through the machine and did not circumvent the shredder or other relevant component. In some examples, an image or multiple images captured by the scanner or other camera within the machine may be saved so that appropriate personnel can review the information collected about a particular drive that was processed by the machine. In some aspects, a microphone may be included, for example, to provide an auditory input record of the drive being destroyed by the shredder to confirm that the drive actually reached the shredder.

Reference will now be made to the Figures, in which like reference numerals refer to like elements throughout the Figures. In many instances, similar elements may be identified by the same reference numeral and differentiated by a different letter suffix in the Figures. Thus in the following text description, elements may be referenced with suffixes (e.g., for referencing individual or specific elements such as a first sensor 326A or a second sensor 326B) or without suffixes (e.g., for generally or collectively referencing elements such as one or more of the sensors 326).

FIG. 1 illustrates a module 102 that may be utilized for regulating input of drives for processing and/or disposal. The term "drive" herein is used as a shorthand for any form of media storage device, regardless of whether a solid state drive, a hard disk drive, or any other form of memory device capable of storing data. In FIG. 1 the module 102 is shown having an enclosure 104, a door 106, a key 108, a hatch 110, and indicator lights 112.

In operation, the door 106 may provide selective access for introduction of drives into the enclosure 104. The enclosure 104 may include or be coupled with other structure to provide a closed loop path to a destination, which may include but is not limited to a shredder or other media damaging component.

The indicator lights 112 may provide any status information that may be relevant to an operator. As non-limiting examples, the indicator lights 112 may signal when the door 106 is ready to be opened to receive an additional drive (e.g., a green light), if the door is locked due to a prior drive still being processed through the enclosure 104 (e.g., a yellow light), or if the door is locked due to a fault that has been detected in the enclosure 104 or related part of the system such that the door 106 will remain closed and/or locked until the fault has cleared (e.g., a red light).

In various embodiments, the hatch 110 can be utilized to gain access to an interior of the enclosure 104 apart from the door 106. For example, the hatch 110 may allow access in a situation in which the door 106 is locked. The hatch 110 is shown receiving a key 108, which may correspond to a key maintained by authorized personnel, such as may be tasked with responding in case a fault is detected during operations controlled by another user. The enclosure 104 may include and/or be coupled with other components, which may include any combination of those discussed with reference to FIG. 2 or FIG. 3 below.

Figure 2:
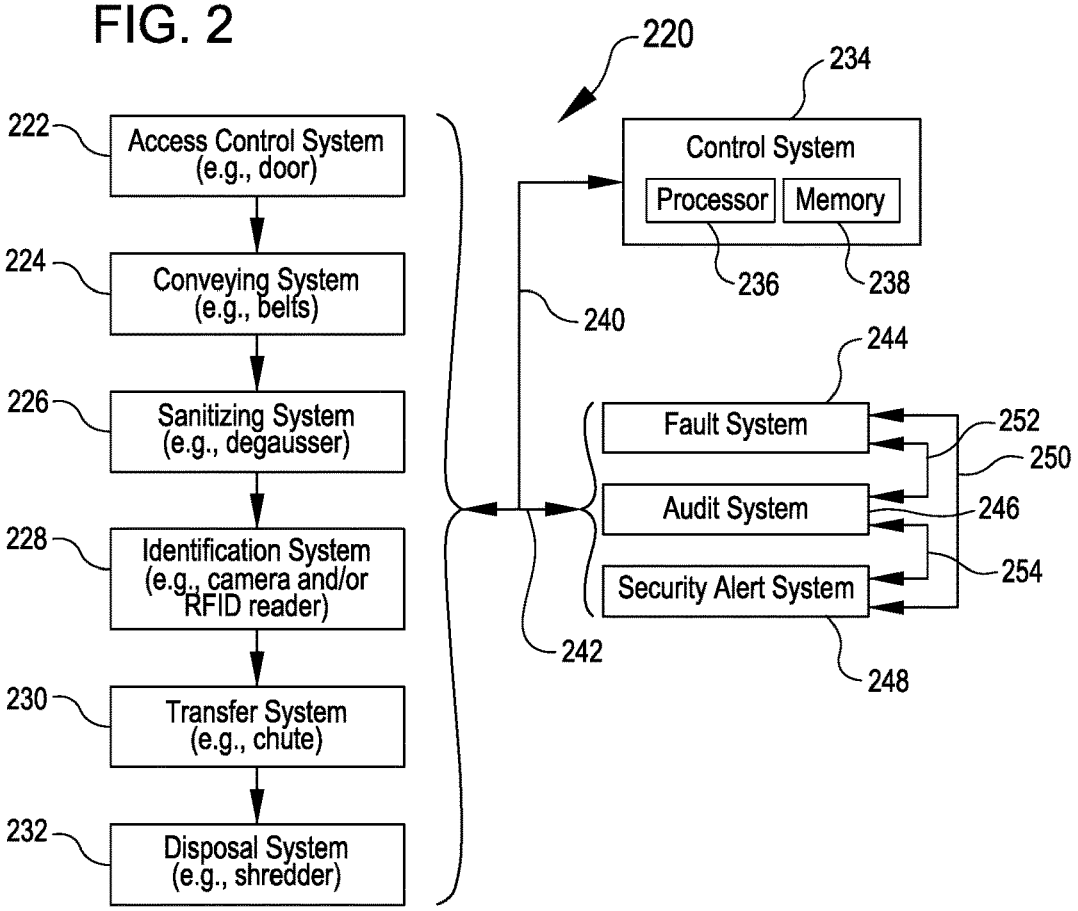
FIG. 2 illustrates a system that may be utilized for processing media storage devices according to various embodiments.

FIG. 2 illustrates a system 220 that may be utilized for processing media storage devices. General functions of various components shown in the system 220 in FIG. 2 will be described with respect to FIG. 2, while various specific examples may also be provided with respect to FIG. 3.

The system 220 depicted in FIG. 2 includes an access control system 222, a conveying system 224, a sanitizing system 226, an identification system 228, a transfer system 230 and a disposal system 232. Respective elements of these components may be in communication (e.g., as at 240) with a control system 234.

The control system 234 can include a processor 236 and memory 238 having instructions stored therein that allow the processor 236 to perform actions which may trigger or otherwise control or interact with elements of other components of the system 220 and provide functions described herein. Some or all of such processes may be performed under the control of one or more computer systems configured with executable instructions and may be implemented as code (e.g., executable instructions, one or more computer programs, or one or more applications) executing collectively on one or more processors, by hardware or combinations thereof. The code may be stored on a computer-readable storage medium, for example, in the form of a computer program comprising a plurality of instructions executable by one or more processors. The computer-readable storage medium may be non-transitory.

The control system 234 and/or other elements may also be associated with, communicate with, and/or interact with (e.g., as at 242) a fault system 244, an audit system 246, and a security alert system 248. Moreover, the fault system 244, the audit system 246, and the security alert system 248 may additionally or alternatively be associated with, communicate with, and/or interact with one another individually and collectively (e.g., as at 250, 252, and 254).

The disposal system 232 can include a shredder or other suitable structure for destroying or physically damaging drives or other media storage devices. The disposal system 232 may render such drives inoperable following such physical damage infliction. In some embodiments, the disposal system 232 may additionally or alternatively include a degaussing system (e.g., which may be related to or separate from the sanitizing system 226) for rendering the drives inoperable, e.g., by magnetically erasing data on the drives. Moreover, although description herein focuses on drives for the sake of simplicity, the disposal system 232 may additionally or alternatively correspond to any form of disposal system for rendering inert or otherwise processing any form of object. As non-limiting examples, the disposal system 232 may alternatively include suitable components for handling medical implements or waste, documents to be shredded or redacted, computer hardware other than drives (e.g., motherboards, memory modules, expansion cards, servers, portable electronic devices), optical storage media, or any other form of object to be processed into a different state. The identification system 228 and/or other elements described herein may also be modified or configured to accommodate such objects instead of drives.

The access control system 222 can include suitable structure for selectively providing access to a path leading to the disposal system 232. For example, the access control system may include elements of the enclosure 104, the door 106, and/or other associated or substitutionary components with respect to FIG. 1. Although the door 106 in FIG. 1 is depicted as a sliding door, the access control system 222 may incorporate another type of barrier that is selectively movable to provide or block access, including, but not limited to, a flap, a pivoting door, a rotating structure, or a bar.

The access control system 222 can additionally or alternative include any suitable components for determining that the barrier is providing or blocking access into the enclosure 104. Non-limiting examples include depressible plungers to detect when the barrier has been moved into a fully open or fully closed position, reed switches, electrical contact switches, or other door closure sensors.

The access control system 222 can additionally or alternatively include any suitable components for maintaining the barrier in the blocking and/or accessible states. Non-limiting examples include electrically actuated locks, magnetic locks, mechanically actuated locks, locks actuatable in response to computer control, or any other form of lock.

The conveying system 224 can include suitable structure for movement of drives among various parts of the system 220. For example, the conveying system 224 may include conveyor belts or other devices. In some examples, a single conveyor belt may be utilized, while in other examples, multiple conveyor belts or other motion imparting devices may be used. In addition to or in lieu of conveyor belts, the conveying system 224 may utilize a hinged panel that can change in orientation in order to allow a drive to slide down a ramp formed by the panel or fall through a space vacated by the panel to a subsequent location within the path toward the disposal system 232. Gears, paddles, hooks, or other pushing and/or pulling devices may additionally or alternatively be utilized by the conveying system 224 to move drives or other components.

The sanitizing system 226 can include a degausser or other component capable of sanitizing or otherwise erasing data from the drives. For example, drives may be conveyed by the conveying system 224 past or through the sanitizing system 226, such as in transit through the enclosure or other portion of the access control system 222.

The identification system 228 can include any suitable elements for obtaining an identity of a drive being processed through the system. Non-limiting examples include an optical sensor (e.g., a bar code or other optical code scanner, or a camera that can provide images for subjecting to an image recognition algorithm to obtain text, an optical code, or other identifying information), an RFID (Radio Frequency Identification) reader, a LIDAR (Light Detection and Ranging) or other sensor configured for obtaining a point cloud corresponding to a three-dimensional representation of the drive, a jack or other mechanism for selectively engaging the drive to read an identifier stored in data on the drive, or any other structure or set of components capable of obtaining information for identifying a drive. For example, drives may be conveyed by the conveying system 224 past or through the identification system 228 to allow identifying information to be obtained, such as in transit through the enclosure or other portion of the access control system 222.

In some embodiments, the control system 234 may process information from the identification system 228 to determine an identity of a drive being processed. For example, the control system 234 may obtain barcode information from the output of the identification system 228 (e.g., by performing an image recognition algorithm to extract the barcode from an image captured by a camera or by receiving barcode information via a barcode scanner) and determine an identity of the drive based on the barcode. As another example, the control system 234 may determine an identity of the drive based on information embedded in an RFID tag read by an RFID reader of the identification system 228.

In some embodiments, the identification system 228 is positioned downstream of the sanitizing system 226 (e.g., as suggested by the top-down progression and arrangement depicted in FIG. 2), while in other embodiments, the identification system 228 may be positioned upstream of the sanitizing system 226 (e.g., corresponding to a reversal of positions shown in FIG. 2 of the sanitizing system 226 and the identification system 228).

The transfer system 230 may be a subcomponent of or provide an addition to the conveying system 224. The transfer system 230 may include any of the types of motion-imparting devices described above for the conveying system 224. The transfer system 230 may function to transfer a drive to the shredder or other component of the disposal system 232 from another component of the system 220 such as the sanitizing system 226 or the identification system 228 (e.g., depending on an order of progression through the system 220). In some embodiments, drives may be conveyed by the transfer system 230 to the disposal system 232 in response to information obtained by the identification system 228. For example, the control system 234 may cause the transfer system 230 to transfer a drive to the disposal system 232 in response to the identity of the drive (e.g., obtained via information from the identification system 228) matching a listing of drives designated for destruction or disposal, and/or the control system 234 may prevent the transfer system 230 from transferring a drive to the disposal system 232 in response to the identity of the drive failing to match a listing of drives designated for destruction or disposal. In some embodiments, drives may be conveyed by the transfer system 230 away from the disposal system 232, for example, into a holding bin or other diversion track in response to the identity of the drive failing to match a listing of drives designated for destruction or disposal.

The fault system 244 may include appropriate components for detecting and/or communicating when a fault that warrants interruption of normal operation is present in the system 220. The fault system 244 may include components for detecting malfunctioning, jamming, or other problematic conditions of any components associated with the access control system 222, the conveying system 224, the sanitizing system 226, the identification system 228, the transfer system 230, the disposal system 232, the audit system 246, and/or the security alert system 248. As a non-limiting example, the fault system 244 may detect that the disposal system 232 is offline (e.g., due to an expected or realized jam in a shredder or due to a collection bin being full), and the control system 234 may respond by causing a door of the access control system 222 to remain locked and not permit introduction of additional drives while the disposal system 232 is unavailable to process such additional drives. Additional examples of operations of the fault system 244 will be described with respect to FIG. 3.

The audit system 246 can include appropriate components for storing information about drives that were processed through the system 220. For example, the audit system 246 may provide information that may be utilized for subsequent retrieval to evaluate activities of drives that have been processed through the system 220. As an illustrative example, the audit system 246 may allow outputs of the system 220 to be cryptographically signed, e.g., such that for a processing of a given drive, unique identification information of the system used, a date, a time, and other relevant details can be registered for subsequent review. For example, the cryptographically signed output may include a structured file encoded and protected by a security signature, which may prevent the file from being accessed in the absence an appropriate decryption key being applied. The output may convey a time, date, etc. of any or all drives respectively processed by a respective system 220 (along with any confirmatory images, recordings, etc.).

The security alert system 248 can include appropriate components for alerting secondary users of the system 220 about conditions of the system 220. For example, the secondary users may be personnel authorized to respond to conditions beyond the authorization level of a primary user of the system 220. As an illustrative example, a primary user may be a datacenter technician tasked with loading drives into the system 220, and a corresponding secondary user may be security personnel tasked with responding and accessing the system 220 (e.g., via the key 108) if any improper or irregular activity is detected for the system 220 (e.g., if a drive failed to be adequately sanitized by the sanitizing system, if a drive failed to be adequately scanned by the identification system 228, and/or if the identity of a drive determined by the control system 234 based on information from the identification system 228 does not match a listing of drives designated for destruction).

Figure 3:
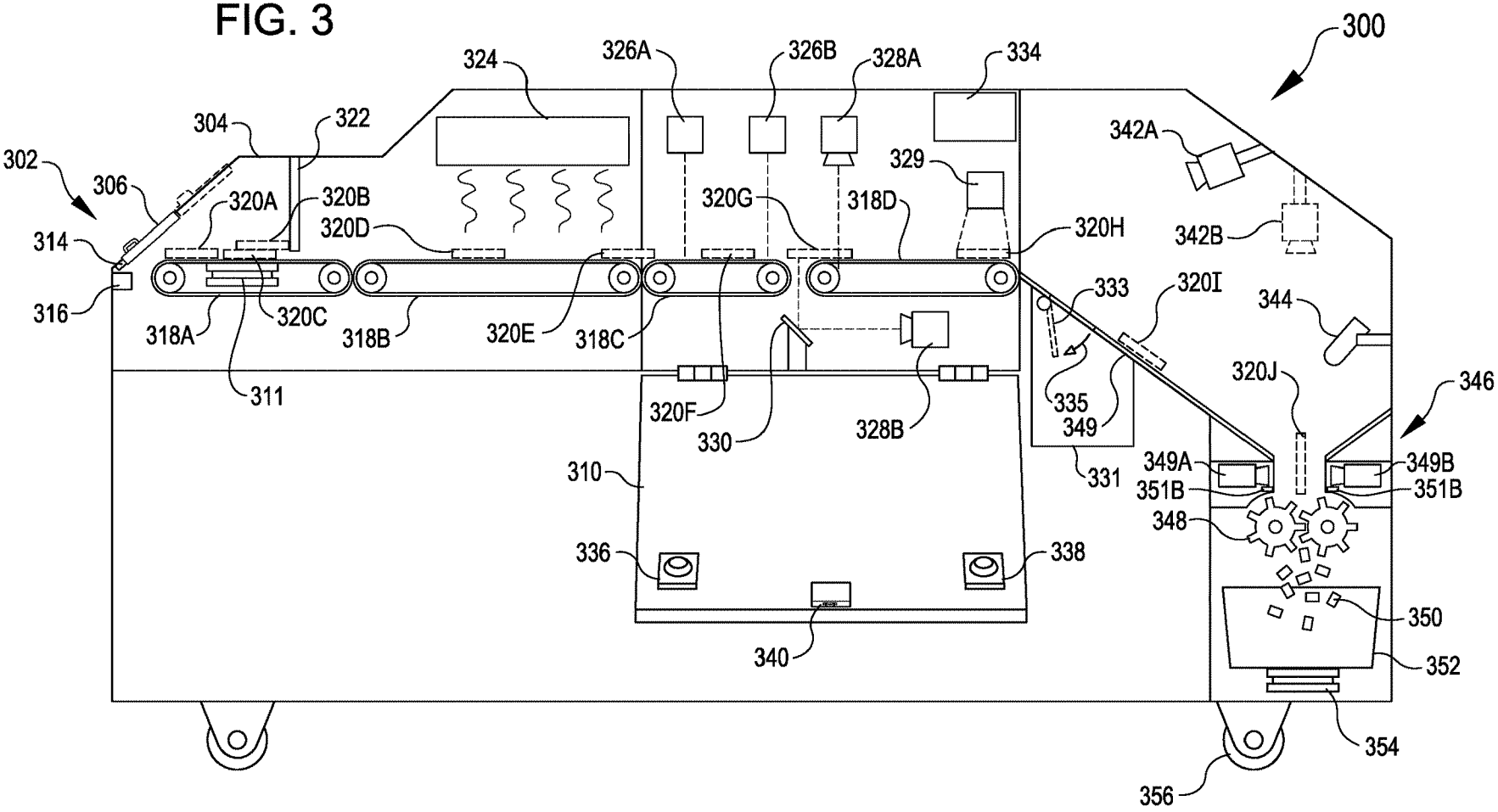
FIG. 3 illustrates an example of an apparatus that includes various components corresponding to elements of the system of FIG. 2 according to various embodiments.

FIG. 3 illustrates an apparatus 300 including various components corresponding to elements of the system of FIG. 2. For example, referring to a left side of FIG. 3, the apparatus 300 includes a barrier 302. The barrier 302 provides selective access to the enclosure 304. The barrier 302 is depicted as a sliding door 306 (which may be an example of the door 106 of FIG. 1), although the barrier 302 may additionally or alternatively correspond to any other form of barrier described with the respect to the access control system 222 of FIG. 2.

The barrier 302 can move between an accessible state in which an introduction of a drive 320 is permitted (e.g., depicted in phantom lines), and the barrier 302 may also be movable to a blocking state in which introduction into the enclosure 304 is prevented or blocked (e.g., depicted in solid lines). For example, the barrier 302 may permit a drive 320A to be placed inside the enclosure 304 when the barrier 302 is in an open state corresponding to that shown in phantom lines in FIG. 3, while the barrier 302 in a closed state may prevent such introduction.

The barrier 302 may be associated with a sensor 314. The sensor 314 may be a door sensor or other structure capable of determining whether the barrier 302 is open or has been moved to a closed position. For example, the closure sensor 314 may provide a signal to a control system 334, which may trigger subsequent actions by the control system 334.

As one example, the control system 334 may activate a lock 316 that may maintain the barrier 302 in a closed position. For example, this may correspond to the barrier 302 remaining closed while a drive 320 is processed through the apparatus 300 before permitting the barrier 302 to move to an open state to permit another drive 320 to be inserted into the enclosure 304 for processing. Hence, although various drives 320A-320J are depicted at various positions in FIG. 3, these instances may correspond to variations in position of a single unit progressing through the apparatus 300. As another example, the control system 334 may initiate movement of a conveyor 318A to move the drive 320A away from the barrier 302 in response to the closure sensor 314 detecting closure of the barrier 302 and/or in response to the lock 316 being activated.

The apparatus 300 can include features to reduce a chance that multiple drives 320 may be processed through the apparatus 300 simultaneously or to limit the apparatus 300 to processing a single drive 320 at a time. As one example, the apparatus 300 in FIG. 3 includes a blocker 322 that is sized and positioned to prevent multiple drives 320 from being advanced in a stack by a conveyor 318A away from the movable barrier 302. For example, the blocker 322 may be sized to be slightly larger than a height of the drive 320C, such that if a second drive 320B is stacked on top of the first drive 320C, the second drive 320B will be knocked off by engaging the blocker 322 as a result of the conveyor 318A advancing the first drive 320C. The blocker 322 may be an example of an additional component of the access control system 222 of FIG. 2. Additionally or alternatively, the blocker 322 may be sized according to a width of a drive 320 to prevent multiple drives 320 from advancing side by side through the apparatus 300.

In FIG. 3, the apparatus 300 includes a degausser 324. For example, the drive 320D is shown being subjected to magnetic fields capable of erasing data on the drive 320D. The degausser 324 is an example of a component of the sanitizing system 226.

The drive 320D may be advanced by a conveyor 318B that may be the same or distinct from the conveyor 318A that draws or moves away from the barrier 302 that controls initial access or input into the apparatus 300. The conveyors 318 can move the drive from the range of the degausser 324 into another section of the apparatus 300. For example, the drive 320E is being shown moved onto another conveyor 318C from the conveyor 318B in FIG. 3. The conveyors 318 are examples of components of the conveying system 224 of FIG. 2 and may be replaced by other arrangements and/or types of motion-imparting devices, including those described previously.

The apparatus 300 depicted in FIG. 3 also includes a sensor 326 capable of detecting an edge of a drive 320F. This can allow the control system 334 to detect if multiple drives 320 have been fed non-independently through the apparatus 300. For example, a first sensor 326A (which may be a laser sensor) can detect when an edge of a drive 320 crosses an associated threshold (e.g., crossing a beam to alter the reflective properties of the beam). The first sensor 326A may detect an edge at the front of the drive 320F and at the rear of the drive 320F. A subsequent sensor 326B can likewise detect a front and rear of the drive 320F. Thus, for example, if the drive 320F passes the first sensor 326A and a drive 320E following behind begins to pass the first sensor 326A before the initial drive 320F is detected as fully passing the second sensor 326B, this may indicate that more than one drive 320 is been processed through the apparatus 300 and/or may register a fault, e.g., as a function of the fault system 244 of FIG. 2. Thus, the sensor 326 may correspond to components of the fault system 244. Similar to the blocker 322, the sensor 326 may also correspond to a component utilized to reduce a possibility of multiple drives 320 being processed simultaneously.

In some embodiments, the first sensor 326A and the second sensor 326B may be spaced apart from one another by an amount corresponding to an expected size of a drive 320. For example, in FIG. 3, the sensors are spaced apart from one another a distance slightly larger than a length of the drive 320F. Such spacing may permit the sensors 326 to detect if multiple drives are included end to end without a gap therebetween. For example, if the sensor 326A and 326B are spaced apart by approximately a length of a single drive 320, then a detection by the second sensor 326B while the first sensor 326A is still detecting a drive 320 may correspond to multiple drives that are abutting one another end to end without a gap in between. Thus, the sensors 326 may, in combination with their spacing, facilitate detection of occurrences of anomalies corresponding to a lack of an edge detection where one would be expected. In some embodiments, the apparatus 300 may accordingly include features to prevent and/or detect multiple drives 320 fed through in a stack (e.g., which may be addressed by a height-tuned blocker 322), side by side (e.g., which may be addressed by a width-tuned blocker 322), or end-to-end (e.g., which may be addressed by a length-tuned spacing of sensors 326).

In some embodiments, the sensors 326 may be used to detect multiple drives 320 entering any space defined between any two points in the apparatus 300. For example, if the sensors 326 were positioned on either side of the degausser 324, the sensors 326 could provide information about whether one drive has been fully processed past the degausser 324 before a subsequent drive 320 reached the degausser 324. The sensors 326 could similarly be placed proximate any two reference points in the apparatus 300 to facilitate detection of a subsequent drive entering the space between the sensors 326 before a prior drive 320 has exited that space between the sensors 326. In some aspects a timer may be triggered by detection from a first sensor 326A and a fault may be registered if a detection by the second sensor 326B is not detected within a particular time threshold anticipated for a drive 320 to move from the first sensor 326A to the second sensor 326B.

Other inputs may also be utilized to provide additional information about whether drives 320 being processed comply with expectations. For example, in FIG. 3, a point cloud sensor 329 is depicted. The point cloud sensor 329 may be a LIDAR or any other variety of sensor capable of detecting a set of points that can provide a three-dimensional representation of a drive 320H. For example, the control system 334 may utilize information from the point cloud sensor 329 for comparing to stored information about what size or form factor the drive 320H is expected to be. If that does not match the stored record, a fault may be triggered through the fault system 244.

The apparatus 300 in FIG. 3 is depicted with a set of scanners 328A and 328B. These may correspond to components of the identification system 228. The first or top scanner 328A is oriented to scan a top of a drive 320G, while the bottom scanner 328B is oriented to detect or scan a bottom side of the drive 320G. For example, the top scanner 328A may have an unobstructed view and correspond to an optical scanner that can obtain an image of the top of the drive 320G, e.g., during conveyance of the drive 320G by the conveyors 318C and/or 318D. The bottom scanner 328B can obtain an image of the bottom side of the drive 320G by light passing from the bottom side of the drive 320G, through a gap between respective conveyors 318C and 318D, off of a mirror 330, and into the bottom scanner 328B.

In operation, images received from the top scanner 328A and the bottom scanner 328B can be processed by the control system 334. For example, the control system 334 may extract bar codes or other identifying information by appropriate image recognition processes or other techniques.

The control system 334 can log the identity of the drive 320 to confirm that the drive 320 has been destroyed via processing through the apparatus 300. For example, the control system 334 may log the identity of the drive 320 as the drive 320 is conveyed onward through the apparatus 300 for destruction.

The apparatus 300 depicted in FIG. 3 includes various components that are examples of components that can be used by the transfer system 230 for advancing a drive 320 for destruction. For example, in FIG. 3, a drive 320H is moved via the conveyor 318D toward a ramp or chute 349. A drive 320I received in the chute 349 may slide or otherwise travel down or along a ramped or other surface toward a shredder 346 for destruction. The shredder 346 can receive a drive 320J whole and output debris 350. The shredder 346 is depicted in FIG. 3 with appropriate teeth 348 or other structure for causing such a conversion of the drive 320J into debris 350, but the shredder 346 may additionally or alternatively correspond to any other suitable device of the disposal system 232. The debris 350 from the shredder 346 may be collected in an appropriate receptacle, such as the collection bin 352 depicted in FIG. 3. Additionally or alternatively, other appropriate conveyance mechanisms (not shown) may be utilized to convey output of the shredder 346 to an appropriate collection bin.

In some aspects, the identity of the drive 320 (e.g., determined based on information from the scanners 328 or other component of the identification system 228) may be utilized to determine whether the drive 320 will be advanced to the shredder 346 or other component of the disposal system 232. For example, the control system 334 may compare the identity of the drive 320 to a database of drives 320 designated for destruction. In various embodiments, advancing of the drive 320 to destruction (e.g., via the conveyor 318D, the chute 349, and/or other element of the transfer system 230) may be prompted by a confirmation of the identity of the drive 320 matching a database of drives 320 designated for destruction. In some embodiments, a drive 320 may be advanced for destruction notwithstanding the drive is not in the database (e.g., although the drive 320 may not necessarily be confirmed as designated for destruction, the control system 334 may nevertheless cause the drive 320 to be advanced for destruction and add the identity of the drive 320 to a registry of drives 320 destroyed by the apparatus 300).

However, in some embodiments, a drive 320 that is not designated for destruction may be retrieved from the apparatus 300 via appropriate access. For example, the apparatus 300 depicted in FIG. 3 includes a security hatch 310. The security hatch 310 may be a further example of a component of the access control system 222. The security hatch 310 may be accessed via a key latch 340, for example, in response to application by authorized personnel of a key (e.g., the key 108 in FIG. 1). For example, the control system 334 may utilize the security alert system 248 to alert the authorized personnel and prompt retrieval of the drive 320 not designated for destruction. In some embodiments, drives 320 not designated for destruction may be re-routed into a containment area 331, e.g., such that other drives 320 can be processed through the apparatus 300 without interrupting operation for retrieval. In FIG. 3, the containment area 331 is shown having a trap door 333 that can be selectively opened (e.g., as depicted by arrow 335) to permit a drive 320 to be detoured into the containment area 331. However, any other appropriate mechanism for pushing, pulling, or causing movement of a drive into a containment area apart from a path toward the shredder 346 or other element of the disposal system 232 can be utilized.

In various examples, respective problems or faults within the operation of the apparatus 300 or system 220 can be routed to authorized personnel (e.g., security personnel) to handle the situation in a manner that may be independent of an individual (e.g., a technician) that would be introducing drives 320 via the barrier 302. For example, the control system 334 may determine that a drive 320G is not designated for destruction based on the identity derived from scanning the drive 320G via the scanners 328, and as a result or in response, the control system 334, may contact personnel through the security alert system 248, for example, to prompt the personnel to retrieve the drive 320G that does not match a listing of drives designated for destruction. As other examples, the control system 334 may contact personnel through the security alert system 248 to prompt access via the security hatch 310 in response to faults detected via the fault system 244 (e.g., detection by sensors 326 of multiple drives 320 in a space where only one drive 320 is authorized or intended, inadequate scanning by a scanner 328, a problem with the degausser 324, a jam in the shredder 346, or an indication that the collection bin 352 needs emptying).

The security hatch 310 in FIG. 3 is shown having a first hatch sensor 336 that can detect if the security hatch 310 is opened. For example, the first hatch sensor 336 may provide a signal to the control system 334, e.g., so that the control system 334 can prevent operation of the apparatus 300 for introduction of new drives 320, such as by locking the barrier 302 via the lock 316. The security hatch 310 in FIG. 3 is also shown including a second hatch sensor 338. The second hatch sensor 338 may be independent of the first hatch sensor 336. For example, the second hatch sensor 338 may provide a signal via the security alert system 248 that will alert authorized personnel when the security hatch 310 is opened, such as to allow appropriate personnel to be notified if the hatch is opened unexpectedly.

The apparatus 300 includes various examples of components that may be examples of the audit system 246. For example, such components may provide information that may be useful for confirming that a particular drive 320 was destroyed the apparatus 300. As one example, the apparatus 300 is shown including cameras 342A and 342B. The position of the cameras 342A and 342B may provide, for example, a set of video footage, still shots, or other visual recordings that can be captured to show a drive 320 progressing through the system and into the shredder 346. Such visual recordings may be useful to access subsequent to the shredding to confirm that the drive 320 identified by the scanners 328 or other elements of the identification system 228 was indeed destroyed or processed by the shredder 346 or other element of the disposal system 232. Although two cameras 342 are shown in FIG. 3, other numbers of cameras may be utilized. In some examples, a camera 342 may pivot to follow the path of a drive 320 (e.g., from the position shown at 342A to the position shown at 342B).

As another example, the apparatus 300 is shown having a microphone 344 that may be included as a component of the audit system 246. The microphone 344 may provide an auditory input to confirm a sound corresponding to the drive 320 progressing through the shredder 346 was produced in a way that confirms that the drive 320 was destroyed or rendered inoperable.

As yet another example, the apparatus 300 includes an input scale 311 and an output scale 354 that may be included as components of the audit system 246. The input scale 311 may be situated within the conveyor 318A or other position and provide a mechanism for obtaining a weight reading of a drive 320 received into the apparatus 300. The output scale 354 may provide a reading regarding a weight of debris 350 received by the collection bin 352. The respective values determined by the scales 311 and 354 may be provided to the control system 334, for example, to determine whether any appreciable difference in weight has been detected that might correspond to some part of the drive 320 not progressing as expected through the apparatus 300.

As yet a further example, the apparatus 300 includes optical sensors 349, such as cameras. The optical sensors 349 may be positioned proximate or adjacent the shredder 346, for example, so that images of both sides of the drive 320J can be obtained as the drive 320J is moved into engagement with the shredder 346. Strobe lights 351A and 351B are also shown and may provide suitable illumination for the optical sensors 349. The strobe lights 351 may be triggered at a suitable duration of time after the drive 320 has passed a particular reference point in the path, such as may be identified by the sensors 326, the sensor 329, the cameras 342B, or other triggering mechanisms. Moreover, although strobe lights 351 are only shown adjacent the optical sensors 349, placement may also be utilized adjacent other elements of the apparatus 300 to provide adequate illumination for respective components.

The apparatus 300 in FIG. 3 also is depicted including wheels 356 that may allow various components of the system 220 to be part of a mobile unit that can be moved around among corresponding computing resource structures in datacenter, for example. Additionally or alternatively, the apparatus 300 may correspond to a stationary unit to which drives that have been decommissioned and bound for destruction can be brought for a corresponding final destruction process that can be confirmed via the scanning within the enclosure 104 in a closed loop manner.

As noted previously, the control system 334 can control the lock 316 to lock the barrier 302 in the blocking state, such as in response to an information from the door sensor 314 indicating that the barrier has been moved to the blocking state. The control system 334 can also control the lock 316 to unlock the barrier 302. Various inputs may be utilized by the control system 334 to trigger unlocking the barrier 302. For example, the control system 334 may cause the barrier 302 to unlock in response to an indication from the audit system 246 that a previously received drive 320 has been processed by the shredder 346 or other component of the disposal system 232 (e.g., in response to a comparison of weight information from the input scale 311 and the output scale 354, in response to receipt of an auditory input from the microphone 344, or in response to footage from a camera 342). The control system 334 may cause the barrier 302 to unlock in response to an indication that a previously received drive 320 has passed a certain point within the apparatus 300 or system 220 (e.g., in response to a sensor 326, a scanner 328, or other component detecting the presence of the drive 320 at a particular location).

In some embodiments, the control system 334 may cause the barrier 302 to unlock in response to a timer reaching a certain level and/or a threshold amount of time elapsing from a triggering event. For example, the control system 334 may cause the barrier 302 to unlock in response to a duration of time elapsing after scanning by the scanner 328. This duration of time elapsing after scanning by the scanner 328 may correspond to an amount of time for the shredder 346 or other component of the disposal system 232 to complete processing of a drive 320. In some embodiments, this duration of time may be tunable to account for the module 102 being interoperable with different varieties of shredders 346 that may each have a different ratio of time for the shredder 346 to complete its task relative to an amount of time conveying, scanning, and/or degaussing may take within the enclosure 104. For example, if the module 102 is switched from a shredder 346 that takes five times as long as the other processing in the enclosure 304 to a shredder 346 that only takes four times as long as the other processing in the enclosure 304, a corresponding timer may be tuned to reduce a delay before the barrier 302 will unlock to permit introduction of the next drive 320.

In some examples, the control system 334 may cause the barrier 302 to unlock in response to a duration of time reckoned from a movement of the barrier 302 to the blocking position. For example, the control system 334 may retain the barrier 302 in a locked position for a duration that corresponds to an amount of time sufficient to allow the drive 320 to pass through relevant stages such as degaussing, scanning, and shredding.

In some embodiments, the control system 334 may allow a subsequent drive 320 to be introduced at a time before a prior drive 320 has been fully processed. For example, the control system 334 may allow unlocking to permit introduction of a subsequent drive 320 as soon as a prior drive 320 is clear of an induction space (e.g., upstream of the blocker 322 or other component defining a transition between stages) or other stage, and/or the control system 334 may subsequently control the conveying system 224 and other components to prevent a subsequent drive 320 from entering a stage while a prior drive 320 is still in that stage.

Although discussion above addresses various features that may be implemented to reduce a likelihood of multiple drives 320 being processed at a time simultaneously through the apparatus 300, embodiments herein are not limited to only arrangements that limit throughput to a single drive 320 at a time. For example, in some embodiments, the scanners 328 and/or other components may be capable of obtaining information from multiple drives 320 simultaneously, for example, which may be useful if the system 220 is implemented with a shredder 346 or other component of a disposal system 232 capable of accepting a throughput of drives 320 faster than the scanners 328 and/or other components can individually process drives one at a time.

Based on the disclosure and teachings provided herein, a person of ordinary skill in the art will appreciate other ways and/or methods to implement the various embodiments. The specification and drawings are, accordingly, to be regarded in an illustrative rather than a restrictive sense. It will, however, be evident that various modifications and changes may be made thereunto without departing from the broader spirit and scope of the disclosure as set forth in the claims.

Other variations are within the spirit of the present disclosure. Thus, while the disclosed techniques are susceptible to various modifications and alternative constructions, certain illustrated embodiments thereof are shown in the drawings and have been described above in detail. It should be understood, however, that there is no intention to limit the disclosure to the specific form or forms disclosed, but on the contrary, the intention is to cover all modifications, alternative constructions, and equivalents falling within the spirit and scope of the disclosure, as defined in the appended claims.

The use of the terms "a" and "an" and "the" and similar referents in the context of describing the disclosed embodiments (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the disclosure and does not pose a limitation on the scope of the disclosure unless otherwise claimed. No language in the specification should be construed as indicating any non-claimed element as essential to the practice of the disclosure.

Disjunctive language such as the phrase "at least one of X, Y, or Z," unless specifically stated otherwise, is intended to be understood within the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

Various embodiments of this disclosure are described herein, including the best mode known to the inventors for carrying out the disclosure. Variations of those embodiments may become apparent to those of ordinary skill in the art upon reading the foregoing description. The inventors expect skilled artisans to employ such variations as appropriate and the inventors intend for the disclosure to be practiced otherwise than as specifically described herein.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A media destruction system, comprising:

an enclosure configured to be situated about a path toward a disposal system;

an identification system configured for obtaining identifying information of a media storage device in the path, the identification system comprising:

a first sensor configured to detect a leading edge and a trailing edge of the media storage device at a first position along the path;

a second sensor configured to detect the leading edge and the trailing edge of the media storage device at a second position along the path, the second position different from the first position; and a controller comprising a processor and a non-transitory computer-readable medium comprising processor-executable instructions to cause the processor to:

indicate that multiple media storage devices are in the path in response to receiving data from the first sensor indicating a second leading edge or a second trailing edge in addition to the leading edge and the trailing edge before receiving data from the second sensor indicating the leading edge or trailing edge;

an access control system comprising:

a selectively movable barrier positioned at an end of the enclosure at an end of the path, the selectively movable barrier configured for selectively permitting introduction of the media storage device into the enclosure, the selectively movable barrier configurable between an accessible state in which introduction into the enclosure is permitted and a blocking state in which introduction into the enclosure is prevented; and a lock configured to lock the selectively movable barrier in the blocking state in response to the selectively movable barrier being moved to the blocking state, the lock configured to unlock the selectively movable barrier in response to a signal produced subsequent to confirming disposal of a previously received media storage device; and an audit system comprising:

an input scale positioned in the path before the disposal system and an output scale positioned at an output of the disposal system, wherein the audit system is configured to:

confirm disposal of the media storage device based on signals from the input scale and the output scale, and convey the signal to cause the lock to unlock the selectively movable barrier subsequent to confirming disposal of the media storage device.

2. The media destruction system of claim 1, further comprising a conveyor configured for moving the media storage device along the path.

3. The media destruction system of claim 2, wherein the processor-executable instructions further cause the processor to:

cause the lock to lock the selectively movable barrier in the blocking state;

cause the conveyor to move the media storage device past the identification system;

determine an identity of the media storage device based on information from the identification system;

cause the conveyor to move the media storage device to the disposal system in response to the identity of the media storage device matching a listing of devices to be destroyed or disposed of; and cause the lock to unlock the selectively movable barrier after moving.

4. The media destruction system of claim 1, further comprising the disposal system.

5. The media destruction system of claim 1, further comprising a degausser degaussing system configured to erase data from the media storage device in the path.

6. The media destruction system of claim 1, wherein the disposal system comprises:

a shredder system configured for rendering media storage devices inoperable; or a degausser configured to erase data from the media storage device in the path; and wherein the identification system further comprises:

an optical scanner configured to obtain a barcode or other optical code from the media storage device;

an RFID reader;

a camera configured to obtain an image of the media storage device, the image obtained is subjected to an image recognition algorithm to obtain the identifying information; or a sensor configured for obtaining a point cloud corresponding to a three-dimensional representation of the media storage device.

7. The media destruction system of claim 1, wherein the audit system further comprises:

a microphone configured to detect auditory input corresponding to the media storage device being processed by the disposal system;

a camera configured to provide a visual recording corresponding to the media storage device being processed by the disposal system;

or a memory configured to store cryptographically encoded data corresponding to a record of the media storage device being processed, the record comprising:

a date;

a time;

an identifier of the media destruction system or of an element of the media destruction system;

an identification of the media storage device obtained by the identification system;

an auditory input;

a visual recording;

weight information; or a still or video image of the media storage device obtained by the identification system.

8. The media destruction system of claim 1, wherein the access control system is configured to interrupt operation in response to:

an indication that the identification system failed to obtain information for identifying the media storage device;

an indication that multiple media storage devices are present in the enclosure;

an indication received that a component upstream or downstream of the identification system has failed;

an indication that a security hatch is open so as to provide access into the enclosure; or an indication that a receptacle for output of the disposal system is full.

9. The media destruction system of claim 1, wherein:

the media destruction system further comprises a door sensor configured to detect the selectively movable barrier being moved between an open state configured for permitting introduction of the media storage device into the path and a closed state configured to block introduction of the media storage device into the path;

the identification system further comprises an optical scanner disposed within the enclosure and configured for optically scanning the media storage device in the path;

the disposal system comprises a shredder configured to receive and shred the media storage device; and the media destruction system further comprises a conveyor configured to move the media storage device along a path toward the shredder.

10. A media destruction system, comprising:

an enclosure configured to be situated about a path toward a disposal system;

an identification system configured for obtaining identifying information of a media storage device in the path, the identification system comprising:

a first sensor configured to detect a leading edge and a trailing edge of the media storage device at a first position along the path;

a second sensor configured to detect the leading edge and the trailing edge of the media storage device at a second position along the path, the second position different from the first position; and a controller comprising a processor and a non-transitory computer-readable medium comprising processor-executable instructions to cause the processor to:

indicate that multiple media storage devices are in the path in response to receiving data from the first sensor indicating a second leading edge or a second trailing edge in addition to the leading edge and the trailing edge before receiving data from the second sensor indicating the leading edge or trailing edge; and an access control system comprising:

a selectively movable barrier positioned at an end of the enclosure at an end of the path, the selectively movable barrier configured for selectively permitting introduction of the media storage device into the enclosure, the selectively movable barrier configurable between an accessible state in which introduction into the enclosure is permitted and a blocking state in which introduction into the enclosure is prevented; and a lock configured to lock the selectively movable barrier in the blocking state in response to the selectively movable barrier being moved to the blocking state, the lock configured to unlock the selectively movable barrier in response to a signal produced subsequent to confirming disposal of a previously received media storage device.

11. The media destruction system of claim 10, further comprising an input scale positioned in the path before the disposal system and an output scale positioned at an output of the disposal system.

12. The media destruction system of claim 11, further comprising an audit system configured to confirm disposal of the media storage device in response to an input weight being within a predetermined amount of an output weight.

13. A media destruction system, comprising:

an enclosure configured to be situated about a path toward a disposal system;

a first sensor configured to detect a leading edge and a trailing edge of a media storage device at a first position along the path;

a second sensor configured to detect the leading edge and the trailing edge of the media storage device at a second position along the path, the second position different from the first position;

a controller configured to receive data from the first sensor and the second sensor and determine that multiple media storage devices are in the path in response to receiving data from the first sensor indicating a second leading edge or a second trailing edge before receiving data from the second sensor indicating the leading edge or trailing edge, an access control system comprising:

a selectively movable barrier formed into a wall of the enclosure and configured for selectively permitting introduction of the media storage device into the enclosure, the selectively movable barrier configurable between an accessible state in which introduction into the enclosure is permitted and a blocking state in which introduction into the enclosure is prevented; and a lock configured to lock the selectively movable barrier in the blocking state in response to the selectively movable barrier being moved to the blocking state, the lock configured to unlock the selectively movable barrier in response to a signal produced subsequent to confirming disposal of a previously received media storage device;

an input scale positioned in the path before the disposal system; and an output scale positioned at an output of the disposal system.

14. The media destruction system of claim 13, further comprising an audit system configured to confirm disposal of the media storage device in response to an input weight being within a predetermined amount of an output weight.

* * * * *